United States Patent [19]

Stern et al.

[11] Patent Number: 4,691,208

[45] Date of Patent: Sep. 1, 1987

[54] FERRITE WAVEGUIDE SCANNING ANTENNA

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 640,183

[22] Filed: Jul. 2, 1984

[51] Int. Cl.[4] ..... H01Q 13/00

[52] U.S. Cl. ..... 343/785

[58] Field of Search ..... 343/785, 911 R, 787, 343/772; 333/158

[56] References Cited

U.S. PATENT DOCUMENTS

| | | | |
|---|---|---|---|
| 3,369,242 | 2/1968 | Johnson | 343/783 |
| 3,761,938 | 9/1973 | Reggia | 343/785 |
| 3,855,597 | 12/1974 | Carlise | 343/787 |

*Primary Examiner*—Theodore M. Blum

*Attorney, Agent, or Firm*—Sheldon Kanars; Jeremiah G. Murray; Robert A. Maikis

[57] ABSTRACT

A phase-scan antenna apparatus including a rod-shaped ferrite dielectric waveguide having two non-ferrite dielectric ends, and means for applying a variable magnetic field to the ferrite section.

9 Claims, 8 Drawing Figures

FERRITE WAVEGUIDE SCANNING ANTENNA

The invention described herein may be manufactured, used, and licensed by or for the Government for governmental purposes without payment to us of any royalty thereon.

CROSS REFERENCE TO RELATED APPLICATION

The subject matter of the instant application is closely related to that of co-pending application Ser. No. 387,986, now U.S. Pat. No. 4,458,218 to the same inventors and entitled "Dielectric Waveguide Reciprocal Ferrite Phase Shifter", filed on June 14, 1982 and issued on July 3, 1984.

BACKGROUND OF THE INVENTION

1. Field Of The Invention

This invention relates to microwave devices in the millimeter wave region, more particularly to scanned, waveguide-type antennas.

2. Description Of The Prior Art

Dielectric waveguide antennas in the millimeter range have generally consisted of two types. They are surface-wave and leaky-wave antennas.

Surface-wave antenna radiation is emitted in a subtantially end-fire direction and occurs due to the truncation of the waveguide. The shape of the radiation pattern is dependent upon the manner of truncation which, by presenting a gradual transition from waveguide cross-section to free-space, may reduce reflection and improve antenna efficiency.

Leaky-wave antennas, the genre of the instant invention, operate on the principle that a small hole in a waveguide (like a water pipe under pressure) will act as a point source radiator, emitting in the direction normal to the point of penetration. If a leaky-wave antenna is properly designed, it radiates a main beam in a sector of sidewards direction.

The principles of leaky-wave antennas are well known and do not form a part of the instant invention. A good treatment of the subject may be found in Collin and Zucker's ANTENNA THEORY, 1969, McGraw and is hereby incorporated by reference.

It is also known in the prior art that a leaky-wave antenna may be swept so as to move the main receptive or transmitting beam through an angle. This sweeping has been accomplished by changing the positional relationship between the E-H wave patterns and the physical geometry of the leaky-wave antenna apertures. One way of accomplishing this is to alter the resonant operating frequency by a permissable amount, such that the frequency stays withinthe safety factor around the chosen operating mode of the waveguide. A better way seems to be to change the phase performance of the dielectric material by an external control means. One such method is shown in U.S. Pat. No. 3,959,794 to Chrepta and Jacobs. In this patent a semiconductor waveguide was used. The phase characteristic of the waveguide is changed by means of PIN diodes which are embedded in one face of the waveguide and are selectively biased on to alter the phase performance. Another known dielectric leaky-wave antenna, described in the 1981 IEEE MIT-S International Microwave Symposium Digest pp. 20–22 teaches a dielectric waveguide embedded in a metal ground plane, one face open to the air and silvered with strips perpendicular to the long axis. Unfortunately, this antenna, though fairly simple in construction, cannot be swept.

SUMMARY OF THE INVENTION

It is an object of the present invention to provide a dielectric waveguide antenna which is both simple and reliable.

It is another object of the invention to provide a single element phase scan antenna which is adaptable to a wide variety of designs and configurations.

It is a still further object of the invention to provide a ferrite phase shift antenna which is operable up to a frequency of 240 GHz.

In accordance with the present invention, the dielectric waveguide scanning antenna includes a section of dielectric/ferrite between an input and output section of non-ferrite dielectric; the ferrite section configured to act as a leaky-wave antenna. Although parallel grooves in one face of the ferrite are shown, it is emphasized that these are merely illustrative and are not intended to convey any limitation on this invention. Two other, parallel sides of sides of the antenna are shown to be provided with a thin slab of low-loss substrate, comprised of cross-linked polymer plastic, for rigidity and ruggedness. There is also a layer of metal applied over the plastic for the purpose of preventing faraday rotation of the wave and instead, forcing a phase change to occur. The final component of the invention is a magnetic biasing circuit by which the phase characteristic of the antenna may be shifted. In the embodiments shown, this may take the form of a separate coil-wound yoke of ferrite which is attached to the antenna so as to form a magnetic circuit. The coil or coils are fed with various strengths and polarities of electric currents in order to sweep the antenna beam through the desired range.

DETAILED DESCRIPTION

Figure 1:
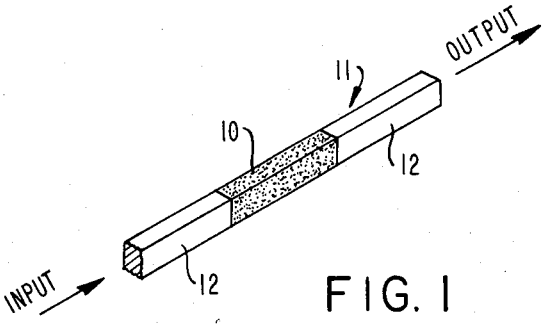
FIG. 1 shows a length of ferrite 10 as a section of a dielectric waveguide transmission line 11.
Figure 2:
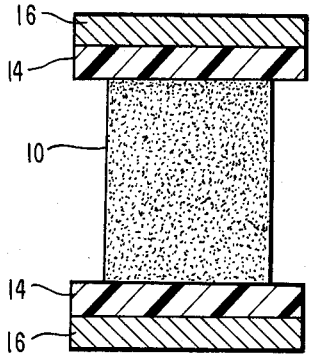
FIG. 2 shows a cross-sectional view of the ferrite section bearing a thin layer of plastic on two surfaces and a layer of conductive metal outside the plastic.
Figure 3:
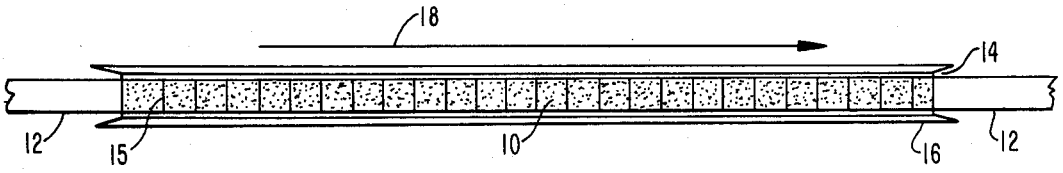
FIG. 3 shows a side view of a ferrite waveguide section with illustrative slot radiators.

Referring to FIG. 1, FIG. 2, and FIG. 3, the antenna 11 employs a length of ferrite, 10 of the same cross sectional dimensions as that of the dielectric waveguide, 12. The length of ferrite, 10 in fact becomes a section of the transmission line 11 as shown. A thin layer of a suitable plastic 14 is placed on top and bottom of the length of ferrite 10. Two small metal plates 16 are then placed on each piece of plastic 14. The length of ferrite section is perturbed in some manner as by parallel grooves 15 so as to cause a radiation pattern 17 to form when properly excited. Further, a variable magnetic bias, as indicated by arrow 18, is applied to the antenna as shown in FIG. 3. The biasing field 18 along the axial length of the ferrite 10 enables magnetization of the ferrite, resulting in a reciprocal phase shift or change in electrical length within the structure. The phase shift achieved is proportional to the strength of the applied H dc field.

The phenomena producing the phase shift is referred to as suppressed rotation or the Reggia-Spencer effect and has been employed in conventional metal waveguide design structures at microwave frequencies.

A significant advantage achieved through the use of this dielectric waveguide antenna 11 is that impedance matching into the structure is not necessary when making the transition from the dielectric guide 12 to the ferrite guide 10. The permittivity ($\epsilon'$) of the dielectric ($\epsilon'=16$) 12 and that of the ferrite ($\epsilon'=13\rightarrow16$) 10 are nearly the same. Thus, the design and construction of the device is simplified and more efficient than conventional antennas. In conventional structures, a transformer section or sections are necessary to impedance match the air filled metal waveguide ($\epsilon'=1$) to that of the ferrite loaded metal guide ($\epsilon'=13\rightarrow16$).

Figure 4:
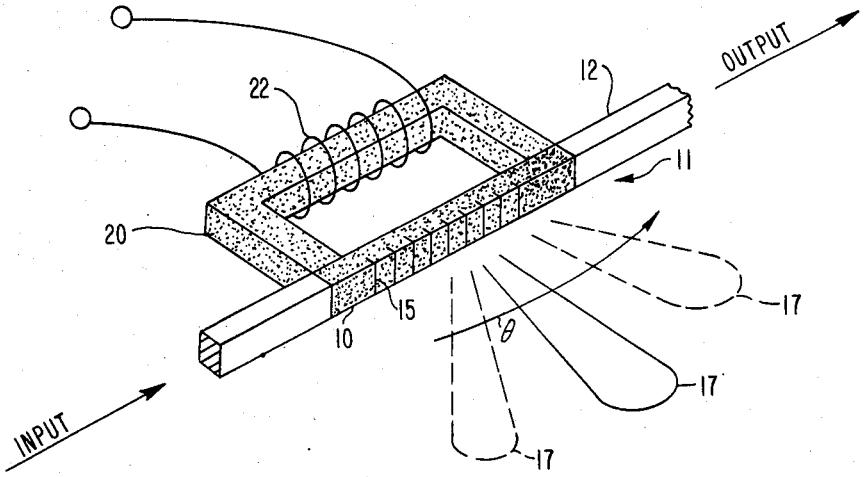
FIG. 4 is a side angular view of the inventive antenna with magnetic biasing ferrite yoke.

A biasing design that works is shown in FIG. 4. In this biasing approach, the ferrite 10 and yoke 20 form a magnetic circuit allowing the switching to be accomplished by a small coil 22 on the return path. The advantage here is that the ferrite return path provides a low reluctance magnetic circuit resulting in low current drive requirements. Moreover, the ferrite can be latched or magnetized and then have no need for a holding current in the coil to retain magnetization. The low reluctance circuit results in retention of the magnetized state. Thus, the ferrite can be switched to various phase states by means of a current pulse of the appropriate polarity and strength, with each state representing a particular antenna beam pointing position. The entire antenna structure is finally mounted on a low-dielectric-constant slab of Rexolite or equivalent low-permittivity, low-loss dielectric substrate for rigidity and ruggedness.

Figure 5:
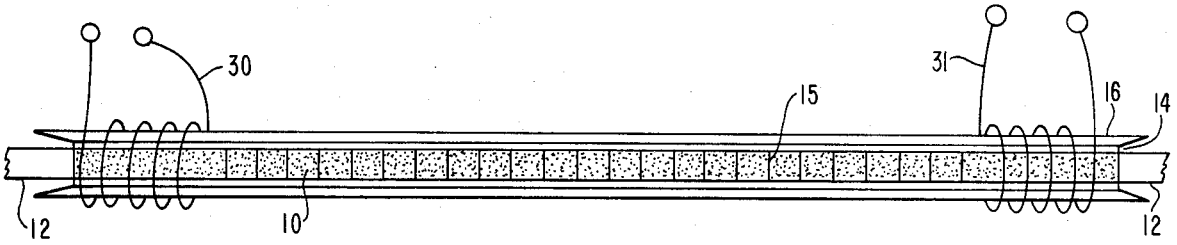
FIG. 5 is a side angular view of a second embodiment with fore and aft end magnetic biasing coils.

The embodiment of FIG. 5 offers a simpler and lower cost design approach to the FIG. 4 design. In this embodiment, no magnetic return path is used, thereby reducing it's size substantially over FIG. 4. Magnetic bias is provided by coils 32 and 30 on each end of the ferrite rod 10. The geometry of the ferrite rod 10 lends itself to becoming a latching device. Although this [and FIG. 6] lacks a magnetic return path, it can still be latched to a substantial remanent state because the long, thin ferrite has a demagnetization factor [Nz] along the axial length of this rod having a value which approaches zero for this rod geometry. The remanent magnetization in the FIGS. 5 and 6 configurations is nearly the same as in a torroid type geometry.

Figure 7:
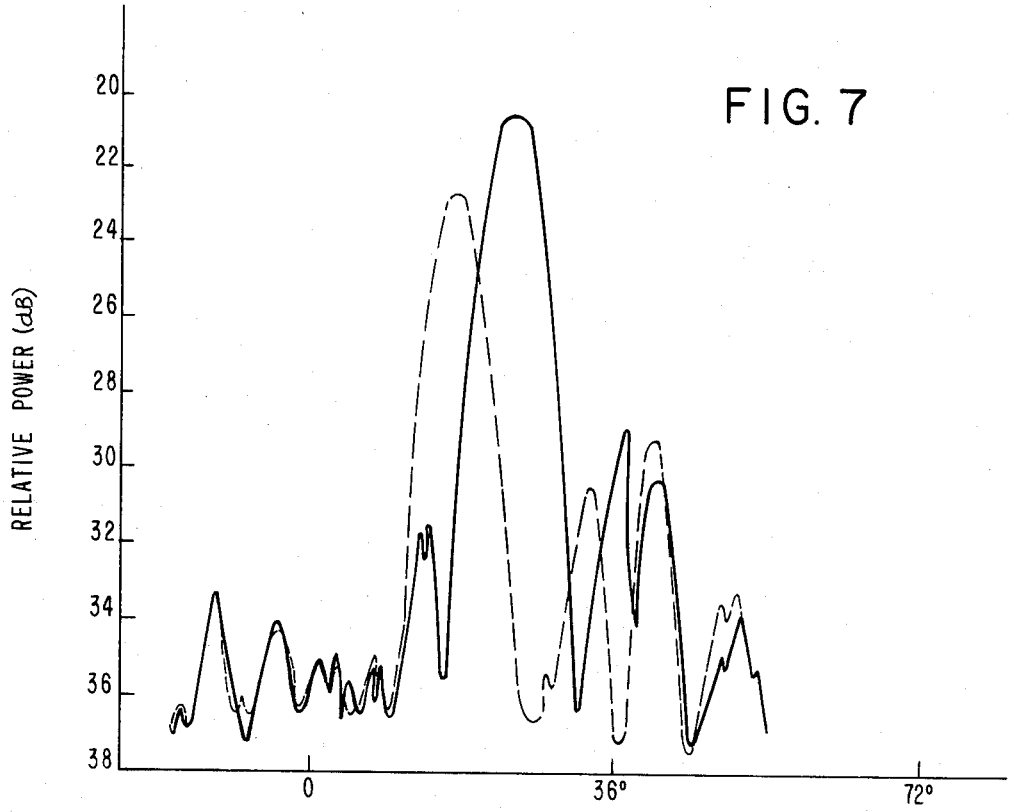
FIG. 7 shows a plot of scan sector extremes for the second embodiment.

FIG. 7 illustrates a plot of the operation of the FIG. 5 embodiment representing the two extremes of scan capability provided by biasing coils 31 and 30. The Figure shows a maximum scan angle of 7 with side lobes around −8 db.

Figure 6:
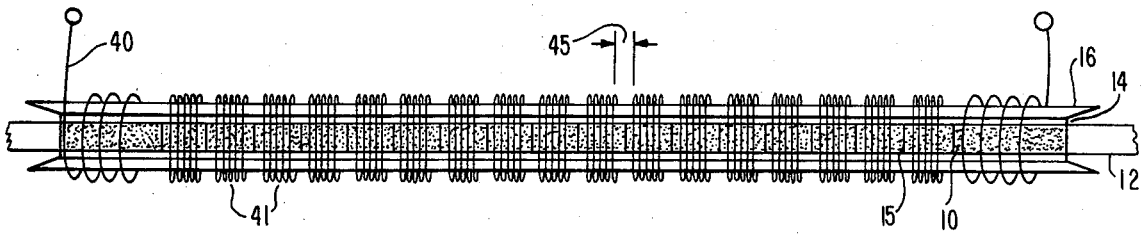
FIG. 6 is a third embodiment with a continuous single biasing coil.

FIG. 6 shows a much wider scan angle embodiment wherein biasing coil 40 is shown distributed along the length of ferrite rod 10. Coil 40 is wound such that none of the grooves 15 is covered and a maximum width window is given each so as not to disturb the antenna beam. This design provides for an increase in flux density because sections 41 of coil 40 are situated between the slots 15; the area where the reciprocal phase shift is generated. Hence the maximum flux region, inside the coils, is positioned directly within the phase shifts region as opposed to the embodiments of FIGS. 4 and 5. The wire coils of this third embodiment will not interfere with transmission/reception of the ferrite antenna as long as an adequate 'window' 45 is provided between adjacent slots. It has further been found that the biasing coil 40 must provide for fringing by the ferrite 10. This is done by winding the biasing coil in such a way that there is a gap of about 0.050" between wire and ferrite. The wire used is 0.006" diameter. Each coil section consists of 5 turns, close together, such that for slot separations of, say, 0.170" there will be a window of about 0.140".

Figure 8:
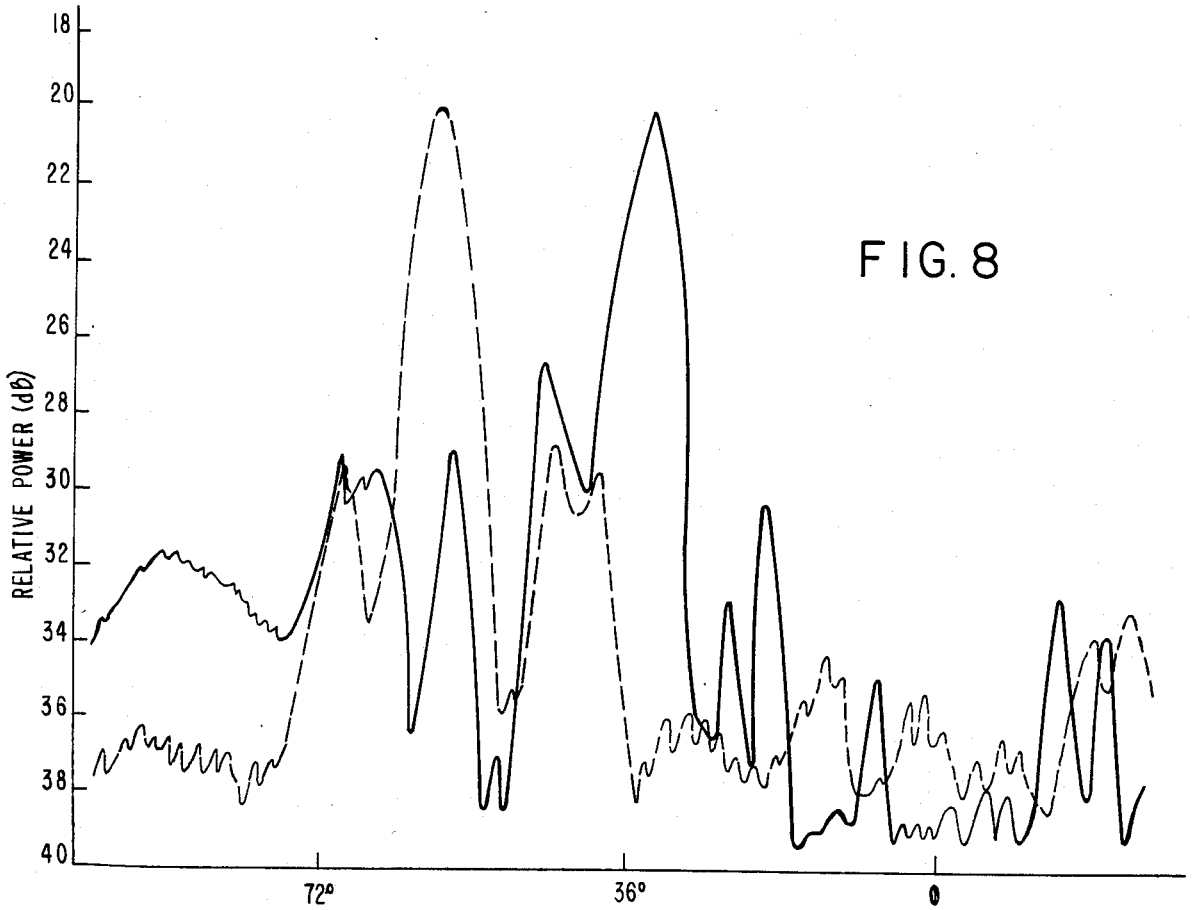
FIG. 8 shows a plot of scan sector extremes for the third embodiment.

FIG. 8 is a plot of scan sector extremes of the embodiment of FIG. 6. There is a three-fold increase over the FIG. 5 embodiment, ~25° as opposed to ~7°, and sidelobe depression remains satisfactory at −6 db or greater.

In the antenna of the instant invention, the ferrite acts both as the phase shifting element as well as being the dielectric medium of transmission. This invention yields high values of phase shift, operates in the 35 GHz frequency range and is based on a simple, low cost design structure.

As the dielectric waveguide material 12, one may use a material having a loss tangent as microwave frequencies of less than 0.001 and a dielectric constant between about 9 and 38. Such materials are exemplified by magnesium titanate and alumina of which magnesium titanate is preferred.

As the ferrite material 10, one may use a material having a saturation magnetization greater than 3000 and a dielectric loss tangent less than 0.005. Examples of such materials are nickel zinc and lithium zinc ferrite.

The ferrite material is joined to the dielectric waveguide material 12 by means of a low loss epoxy or adhesive such as Scotch-Weld Structural Adhesive as marketed by the 3M Company of Saint Paul, Minn.

The layer of plastic 14 should combine good physical and excellent electrical properties including low loss and low dielectric constant. A particularly suitable plastic in this connection is a thermoset cross-linked styrene copolymer "Rexolite 1422" as marketed by C-LEC company of Beverly, N.J.

As the metal plate 16, one may use a material that is a good electrical conductor such as brass, aluminum, silver etc.

We wish it to be understood that we do not desire to be limited to the exact details as described for obvious modifications will occur to a person skilled in the art.

What is claimed is:

1. Phase-scan antenna apparatus comprising:

a rod-shaped length of dielectric waveguide having a major axis extending the length thereof, said waveguide having two non-ferrite dielectric rod-shaped sections fabricated of relatively high dielectric constant material forming the ends of said rod-shaped length of waveguide; and a rod-shaped section of ferrite dielectric disposed between and joining said two non ferrite dielectric sections, said ferrite dielectric section being fabricated of a material having a dielectric constant which closely matches the dielectric constant of said non-ferrite dielectric sections and being equipped with means for permitting electro-magnetic wave radiation to be emitted from or received by said ferrite section in a direction generally perpendicular to said major axis of said waveguide.

2. Apparatus as in claim 1 further comprising beam angle shifting means for affecting the relative angle between said waveguide and said emitted or received radiation.

3. Apparatus as in claim 2 wherein said shifting means comprises a magnetizing means for applying a variable magnetic field to said ferrite section.

4. Apparatus as in claim 3 wherein said magnetizing means comprises a ferrite yoke and a magnetizing coil wound thereon, said yoke being attached to said ferrite section so as to form a complete magnetic circuit.

5. Apparatus as in claim 4 wherein said ferrite section is provided with an additional dielectric layer on two opposite sides of said waveguide.

6. Apparatus as in claim 5 wherein said additional dielectric layers are provided with a conductive layer.

7. Apparatus as in claim 3 wherein said magnetizing means comprises switching coil means wound around said ferrite dielectric waveguide section for applying a variable magnetic field to said antenna.

8. Apparatus as in claim 7 wherein said switching coil means comprises two sections, one section wound around each end of said ferrite dielectric waveguide section.

9. Apparatus as in claim 7 wherein said switching coil means comprises a series of coil sections, connected end-to-end and distributed along the length of said ferrite section such that said coil sections do not interfere with said means for permitting radiation to be either emitted from or received by said ferrite section.

* * * * *